US006723910B1

(12) United States Patent
Tsou et al.

(10) Patent No.: US 6,723,910 B1
(45) Date of Patent: Apr. 20, 2004

(54) REVERBERATION GENERATION PROCESSOR

(75) Inventors: Chih-Hsien Tsou, Taipei (TW); Wei-Peng Tsai, Penghu (TW)

(73) Assignee: Silicon Integrated Systems Corp., Hsin chu (TW)

( * ) Notice: Subject to any disclaimer, the term of this patent is extended or adjusted under 35 U.S.C. 154(b) by 0 days.

(21) Appl. No.: 10/295,947

(22) Filed: Nov. 18, 2002

(51) Int. Cl.[7] ..... G10H 1/02; G10H 7/00
(52) U.S. Cl. ..... 84/630; 84/622; 84/662
(58) Field of Search ..... 84/600–602, 609–611, 84/622–626, 630, 649–652, 659–662

(56) References Cited

U.S. PATENT DOCUMENTS

| | | | | | |
|---|---|---|---|---|---|
| 4,031,795 | A | * | 6/1977 | Bunger | 84/705 |
| 4,727,581 | A | * | 2/1988 | Bray | 381/63 |
| 5,241,604 | A | * | 8/1993 | Noguchi | 381/63 |
| 5,386,082 | A | * | 1/1995 | Higashi | 84/630 |
| 5,543,579 | A | * | 8/1996 | Morinaga et al. | 84/701 |
| 5,917,917 | A | * | 6/1999 | Jenkins et al. | 381/63 |
| 6,091,824 | A | * | 7/2000 | Lin et al. | 381/63 |
| 6,483,922 | B1 | * | 11/2002 | Limacher | 381/63 |

* cited by examiner

*Primary Examiner*—Marlon T. Fletcher
(74) *Attorney, Agent, or Firm*—Birch, Stewart, Kolasch & Birch, LLP

(57) ABSTRACT

A reverberation generation processor. The reverberation generation processor generates a specific auditory signal according to a predetermined virtual environment having characteristics of spatial dimension, sound reflection, and decline. The natural sequence generator generates a natural sequence having a predetermined number of items according to the characteristics of the virtual environment. The sequence adjusting device adjusts gains of the items and a time scale between the items of the natural sequence and outputs an audio signal. The filter processor filters a predetermined frequency band of the audio signal according to the characteristics of the virtual environment and divides the filtered audio signal into a high frequency audio signal and a low frequency audio signal. The high frequency reverberation generator transforms the high frequency audio signal to a high frequency reverberation signal. The low frequency reverberation generator transforms the low frequency audio signal to a low frequency reverberation signal. The output device combines the high frequency reverberation signal and the low frequency reverberation signal to output the specific auditory signal.

16 Claims, 3 Drawing Sheets

REVERBERATION GENERATION PROCESSOR

BACKGROUND OF THE INVENTION

1. Field of the Invention

The present invention relates in general to a reverberation generation processor. In particular, the present invention relates to a reverberation generation processor for simulating a virtual environment.

2. Description of the Related Art

Virtual auditory displays (including computer games, virtual reality systems or computer music workstations) create virtual worlds in which a virtual listener can hear sounds generated from sound sources within these worlds. In addition to reproduce sound as generated by the source, the computer also processes the source signal to simulate the effects of the virtual environment on the sound emitted by the source. In a computer game, the player hears the sound that he/she would hear if he/she were located in the position of the virtual listener in the virtual world.

One important environmental factor is reverberation, which refers to the reflections of the generated sound which bounce off objects in the environment. Reverberation can be characterized by measurable criteria, such as the reverberation time, which is a measure of the time it takes for the reflections to become imperceptible.

FIG. 1 is a graph depicting the time and intensities of the direct sound, early reflection, and late reverberation components. The first signal that reaches the listener is the direct signal which undergoes no reflection. Subsequently, a series of discrete "early" reflections are received during an initial period of the reverberation response. Finally, after a critical time, the "late" reverberation is modeled statistically because of the combination and overlapping of the various reflections. The magnitudes of Reflections_delay and Reverb_delay are typically dependent on the size of the room and on the position of the source and the listener in the room.

Research continues in methods to create realistic sounds in virtual reality and gaming environments. However, the related circuits are complicated.

SUMMARY OF THE INVENTION

The object of the present invention is to provide a reverberation generation processor to simulate the reverberation effect as shown in FIG. 1.

To achieve the above-mentioned object, the present invention provides a reverberation generation processor for generating a specific auditory signal according to a predetermined virtual environment having characteristics of spatial dimension, sound reflection, and decline. The natural sequence generator generates a natural sequence having a predetermined number of items according to the characteristics of the virtual environment. The sequence adjusting device adjusts gains of the items and a time scale between the items of the natural sequence and outputs an audio signal. The filter processor filters a predetermined frequency band of the audio signal according to the characteristics of the virtual environment and divides the filtered audio signal into a high frequency audio signal and a low frequency audio signal. The high frequency reverberation generator transforms the high frequency audio signal to a high frequency reverberation signal. The low frequency reverberation generator transforms the low frequency audio signal to a low frequency reverberation signal. The output device combines the high frequency reverberation signal and the low frequency reverberation signal to output the specific auditory signal.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

The reverberation generation processor according to the embodiment of the present invention is applied to computer games, virtual environment systems or electrophonic music systems. The reverberation effects are generated according to the parameters of the virtual environment, such as spatial dimension, sound reflection and decline and the medium in the virtual environment for transmitting sound.

Figure 1:
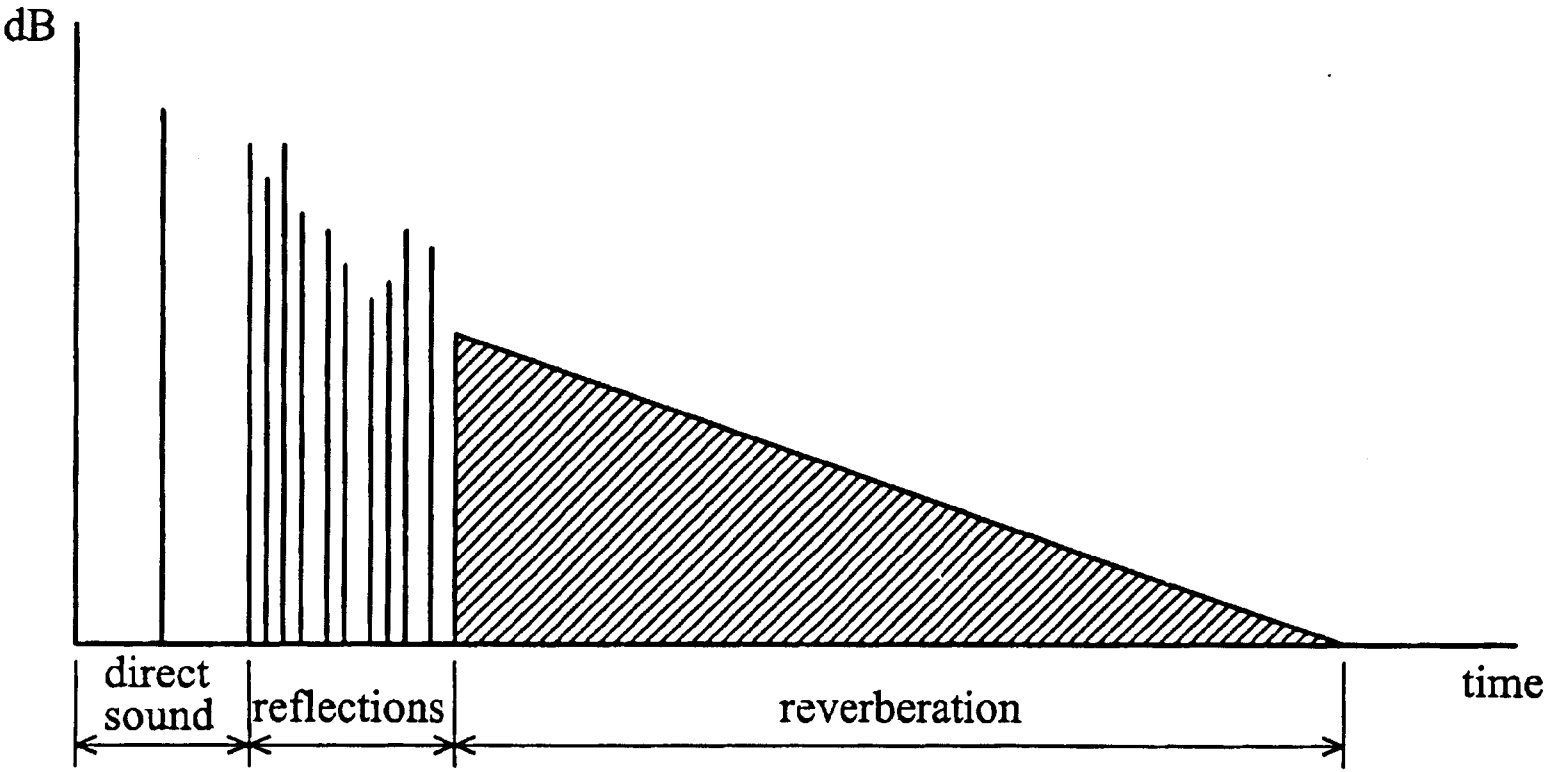
FIG. 1 ( PRIOR ART )
FIG. 1 is a graph depicting the time and intensities of the direct sound, early reflection, and late reverberation components.
Figure 2:
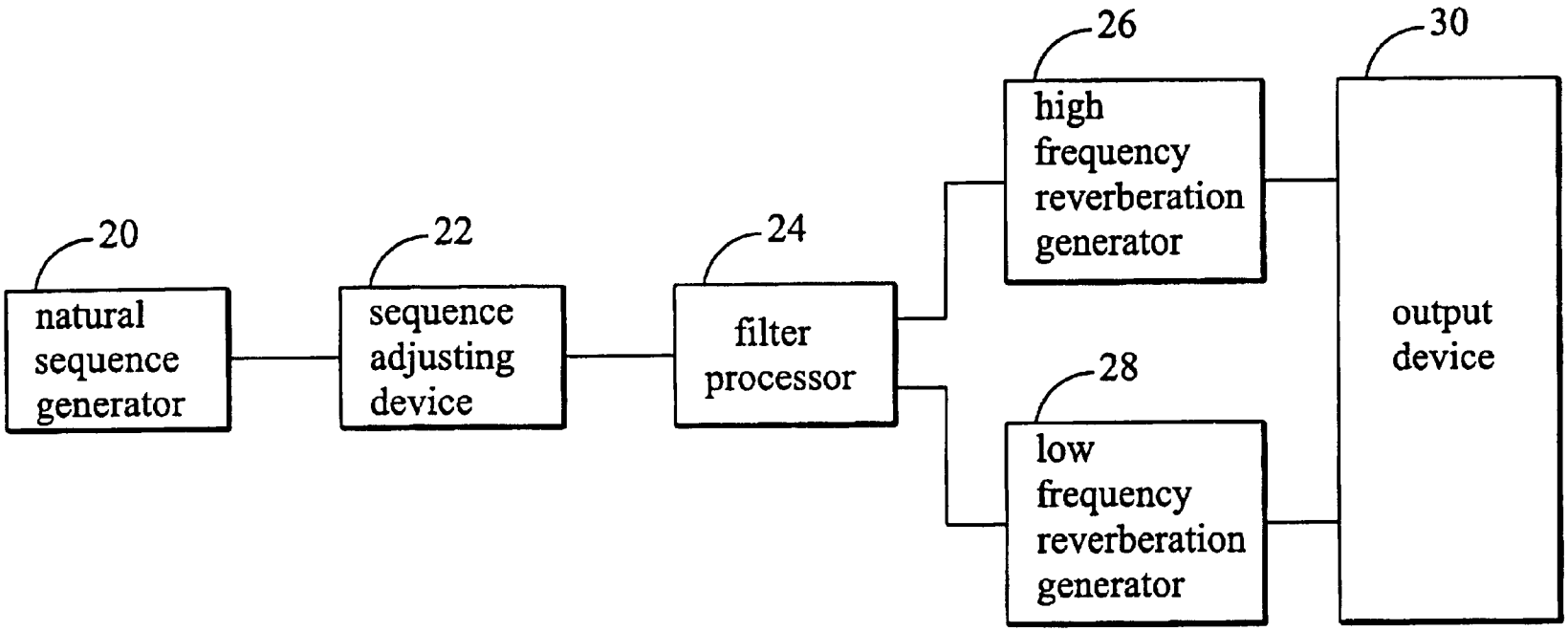
FIG. 2 shows a block diagram of the reverberation generation processor according to the embodiment of the present invention.

FIG. 2 shows a block diagram of the reverberation generation processor according to the embodiment of the present invention. The natural sequence generator 20 generates a Fibonnacci sequence having a predetermined number of items according to the characteristics of the virtual environment. The pulses of the Fibonnacci sequence are [1, 2, 3, 5, 8, 13 . . . ]. The general formula of Fibonnacci sequence is:

$$F_{n+2}=F_n+F_{n+1} \text{ and } F_0=1,\ F_1=1.$$

Fibonnacci sequence fits in with the situation of the combination of sound. To model the different environment size and reflection coefficient, gain and time scales are applied. The used sequence length is according to the different environment sets. For example, when in a small and non-absorptive room, the sequence length is longer than in an open environment. When in a spacious environment, the time base set is multiplied by larger integers than with less spacious environments. If in an absorptive room, such as a carpeted lobby, the gain applied to each item is smaller than an uncarpeted one. In addition, the time scale of the sequence also depends on the environment sets. When in a larger room, the sound reflected to a listener requires longer time, so the time between each item of the sequence is larger. If in a smaller room, the sound is reflected to the listener immediately, so the time between each item of the sequence is smaller. Here, the gain and time scale are set by the sequence adjusting device 22.

In addition, the sound decline is based on the air medium state. Therefore, the filter processor 24 filters a predetermined frequency band of the sound according to the characteristics of the air medium of the virtual environment. For example, the high frequency signal declines more sharply in a wet environment, so the filter processor 24 filters a portion of high frequency signal by a low pass filter to model the real effect. Moreover, the filtered signal is divided into a high frequency audio signal and a low frequency audio signal because the different frequency audio signals have different reverberation.

Figure 3:
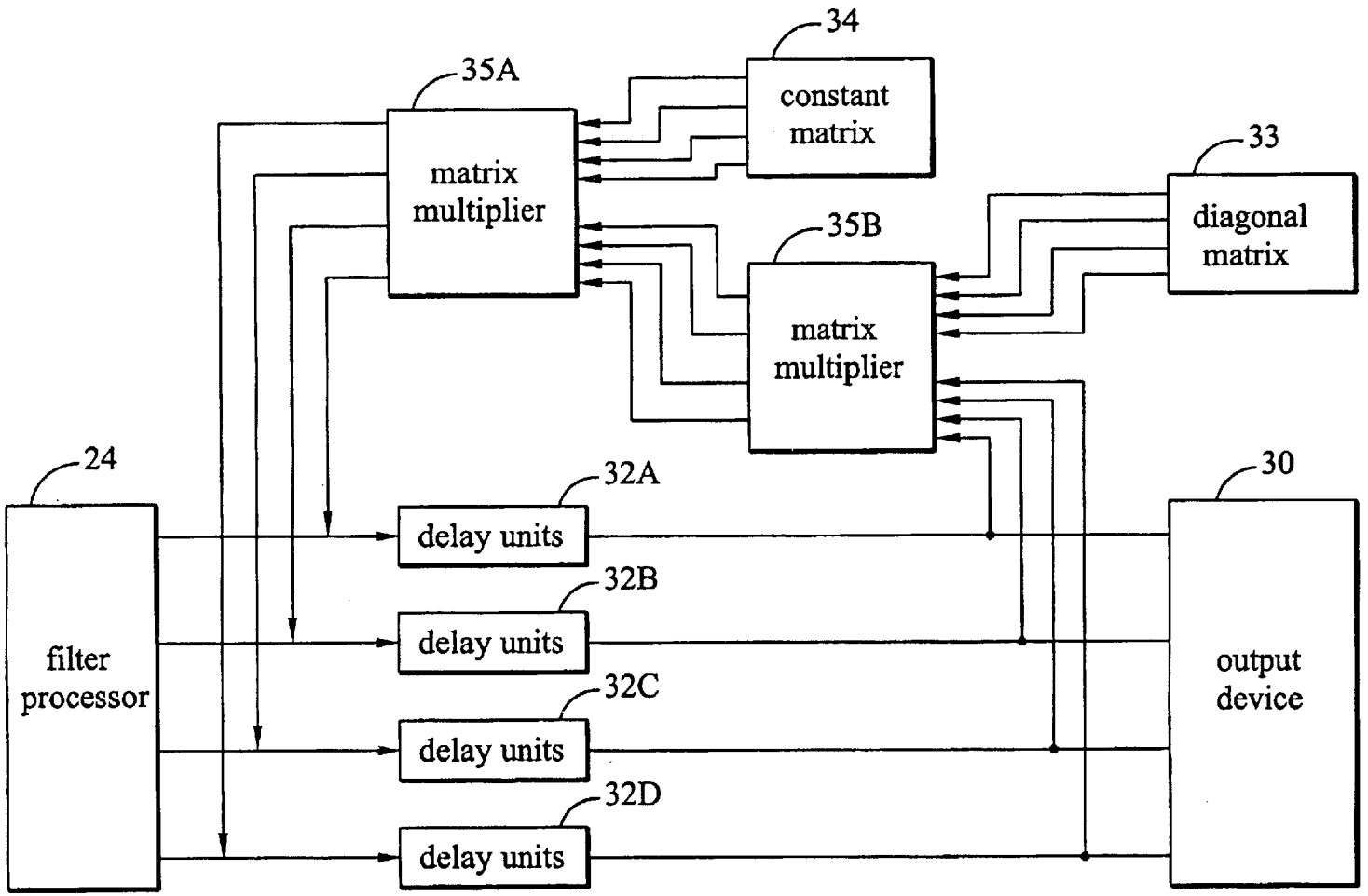
FIG. 3 shows the structures of the high frequency reverberation generator and the low frequency reverberation generator according to the embodiment of the present invention.

Next, the high frequency audio signal and the low frequency audio signal are input to a high frequency reverberation generator 26 and a low frequency reverberation generator 28, respectively. FIG. 3 shows the structures of the high frequency reverberation generator and the low frequency reverberation generator according to the embodiment of the present invention. The high frequency reverberation generator 26 and the low frequency reverberation generator 28 comprise equal structures and generate high frequency reverberation signals and low frequency reverberation signals, respectively. The audio signals input by the filter processor 24 are delayed by the delay units 32A–32D to generate reverberation signals and are then transmitted to the output device 30. In addition, the output reverberation signals are fed back to matrix multipliers 35A and 35B and added to the parameter provided by the diagonal matrix 33 and constant matrix 34. Here, the parameters of the matrix multipliers 35A and 35B in the high frequency reverberation generator 26 and the low frequency reverberation generator 28 are different because the reflection between high frequency audio signals and low frequency audio signals is different. In addition, the parameters are set up according to the spatial dimension, sound reflection, and decline of the virtual environment.

Finally, the high frequency reverberation signals and low frequency reverberation signals are output to an output device 30. The output device can be a sound card, a microphone, or a musical instrument digital interface.

Accordingly, the reverberation generation processor according to the embodiment of the present invention using the audio signal in Fibonnacci sequence form simulates a vivid virtual environment according to the characteristics of the environment, such as spatial dimension, sound reflection and decline, provided by a soft program. Moreover, the present invention provides a reverberation generation processor with good performance and simplifies the circuit structure of the prior art.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A reverberation generation processor for generating a specific auditory signal according to a predetermined virtual environment having characteristics of spatial dimension, sound reflection and decline, comprising:

a natural sequence generator for generating a natural sequence having a predetermined number of items according to the characteristics of the virtual environment;

a sequence adjusting device for adjusting gains of the items and a time scale between the items of the natural sequence and outputting an audio signal;

a filter processor for filtering a predetermined frequency band of the audio signal according to the characteristics of the virtual environment and dividing the filtered audio signal into a high frequency audio signal and a low frequency audio signal;

a high frequency reverberation generator for transforming the high frequency audio signal to a high frequency reverberation signal;

a low frequency reverberation generator for transforming the low frequency audio signal to a low frequency reverberation signal;

an output device for combining the high frequency reverberation signal and the low frequency reverberation signal to output the specific auditory signal.

2. The reverberation generation processor as claimed in claim 1, wherein the natural sequence is a Fibonnacci sequence.

3. The reverberation generation processor as claimed in claim 1, wherein the time scale of the natural sequence corresponds to the spatial dimension of the virtual environment.

4. The reverberation generation processor as claimed in claim 3, wherein the time scale of the natural sequence is relatively larger when the spatial dimension of the virtual environment are relatively larger.

5. The reverberation generation processor as claimed in claim 3, wherein the time scale of the natural sequence is relatively small when the spatial dimension of the virtual environment is relatively small.

6. The reverberation generation processor as claimed in claim 1, wherein the gains of the natural sequence items correspond to the sound reflection of the virtual environment.

7. The reverberation generation processor as claimed in claim 6, wherein the gains of the natural sequence items are relatively larger when the sound reflection of the virtual environment is relatively active.

8. The reverberation generation processor as claimed in claim 6, wherein the gains of the natural sequence items are relatively small when the sound reflection of the virtual environment is relatively poor.

9. The reverberation generation processor as claimed in claim 1, wherein the filter processor filters the predetermined frequency band of the audio signal according to the sound decline of the virtual environment.

10. The reverberation generation processor as claimed in claim 9, wherein the filter processor is a low pass filter for filtering signals having frequencies higher than a predetermined frequency.

11. The reverberation generation processor as claimed in claim 9, wherein the predetermined frequency is relatively low when the sound decline of the virtual environment is sharp.

12. The reverberation generation processor as claimed in claim 1, wherein the high frequency reverberation generator transforms the high frequency audio signal to the high frequency reverberation signal according to a predetermined parameter of the virtual environment.

13. The reverberation generation processor as claimed in claim 1, wherein the low frequency reverberation generator transforms the low frequency audio signal to the low frequency reverberation signal according to the predetermined parameter of the virtual environment.

14. The reverberation generation processor as claimed in claim 1, wherein the output device is a sound card.

15. The reverberation generation processor as claimed in claim 1, wherein the output device is a microphone.

16. The reverberation generation processor as claimed in claim 1, wherein the output device is a musical instrument digital interface.

* * * * *